US007043781B1

(12) United States Patent
Madison

(10) Patent No.: US 7,043,781 B1
(45) Date of Patent: May 16, 2006

(54) MATTRESS FOUNDATION AND BED FRAME

(76) Inventor: Jeffery B. Madison, 10187 SW. Highway 54, Augusta, KS (US) 67010-7511

( * ) Notice: Subject to any disclaimer, the term of this patent is extended or adjusted under 35 U.S.C. 154(b) by 0 days.

(21) Appl. No.: 11/129,974

(22) Filed: May 16, 2005

(51) Int. Cl.
*A47C 19/04* (2006.01)

(52) U.S. Cl. ..... 5/400; 5/308; 5/202; 5/185

(58) Field of Classification Search ..... 5/200.1, 5/201, 202, 285, 286, 400, 181, 183–185, 5/308

See application file for complete search history.

(56) References Cited

U.S. PATENT DOCUMENTS 1,640,754 A * 8/1927 Covey ..... 5/183
2,290,615 A * 7/1942 Firestone ..... 5/187
2,558,625 A * 6/1951 Pearce ..... 5/183
3,745,596 A * 7/1973 Copeland ..... 5/308
4,391,008 A * 7/1983 Yamaoka et al. ..... 5/200.1
4,613,999 A * 9/1986 Franco et al. ..... 5/400
4,888,838 A * 12/1989 Pelski ..... 5/207
5,099,529 A * 3/1992 Anderson ..... 5/400
5,469,589 A * 11/1995 Steed et al. ..... 5/400
5,564,140 A * 10/1996 Shoenhair et al. ..... 5/400

* cited by examiner

*Primary Examiner*—Michael Trettel
(74) *Attorney, Agent, or Firm*—Stinson Morrison Hecker LLP

(57) ABSTRACT

A foundation for supporting a mattress is the subject of this invention. The foundation includes first and second side boards which present a mattress supporting surface and are adapted to be coupled with a head board and a foot board. A plurality of tenon and yoke assemblies are coupled with the side boards in spaced apart relationship along the length of the side boards; the assemblies on one side board being aligned with those on the other side board. A plurality of stretcher boards are adapted to be received by the tenon and yoke assemblies and include slots to accommodate relative movement between the stretcher boards and the side boards. Nut and bolt assemblies are provided for holding the stretcher boards rigid relative to the tenon and yoke assemblies. A single stretcher board can accommodate two or more different sizes of mattresses. Optional drawers may be provided in the side boards to occupy the space which would be consumed by a box springs in a conventional mattress construction. The foundation according to the invention can be shipped in a compact, unassembled form which saves shipping expense as well as warehousing space.

12 Claims, 3 Drawing Sheets

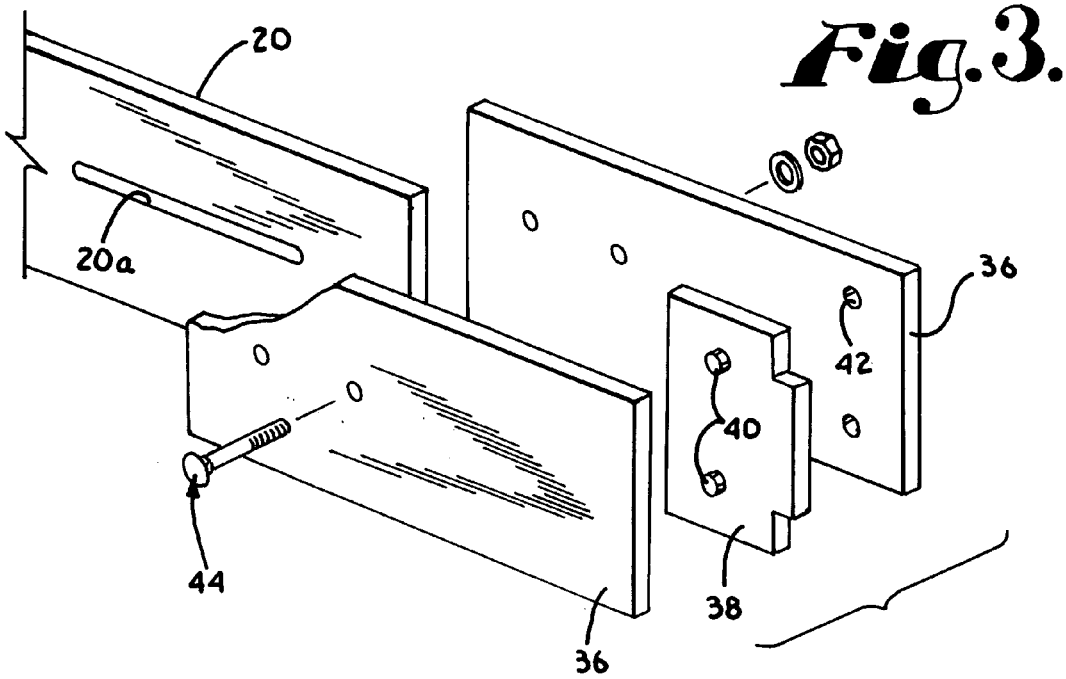
Fig. 3.
Fig. 4.
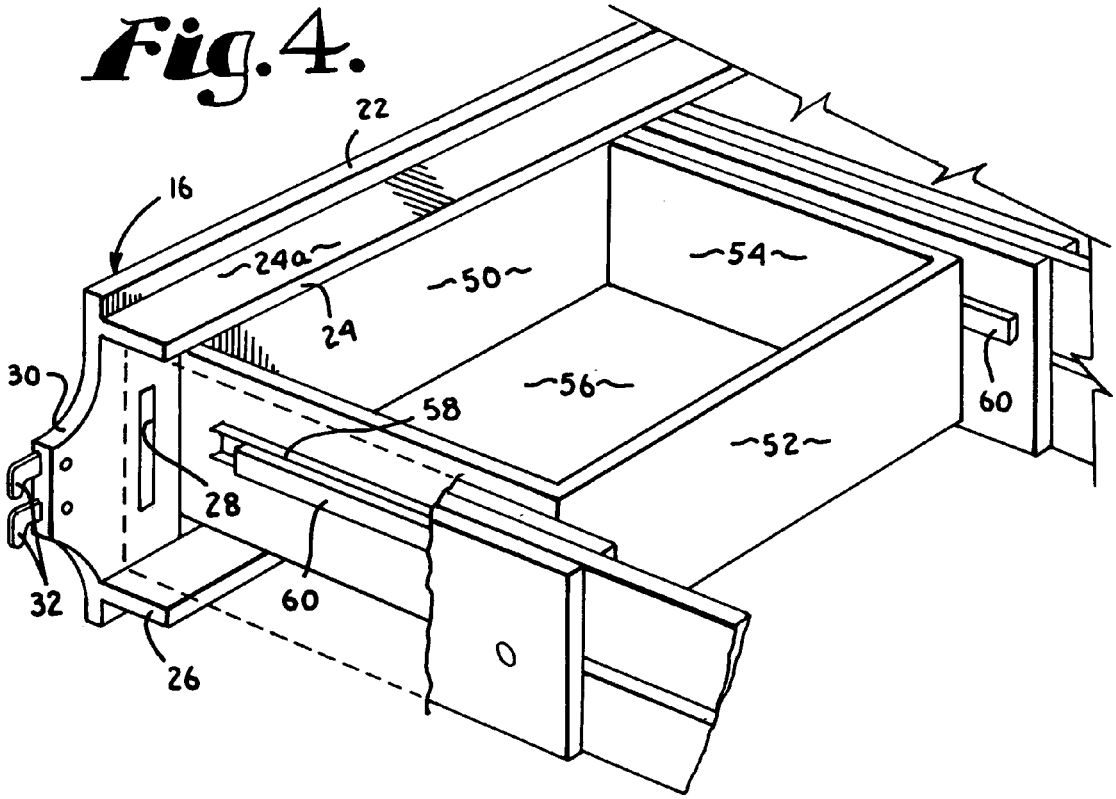

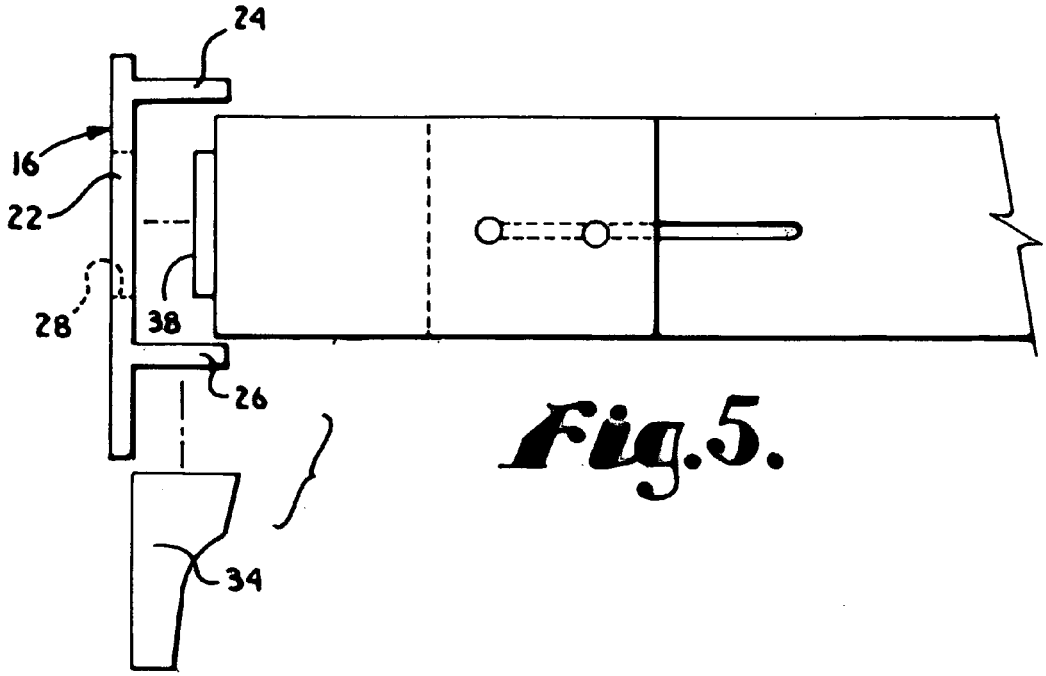
Fig.5.
Fig.6.
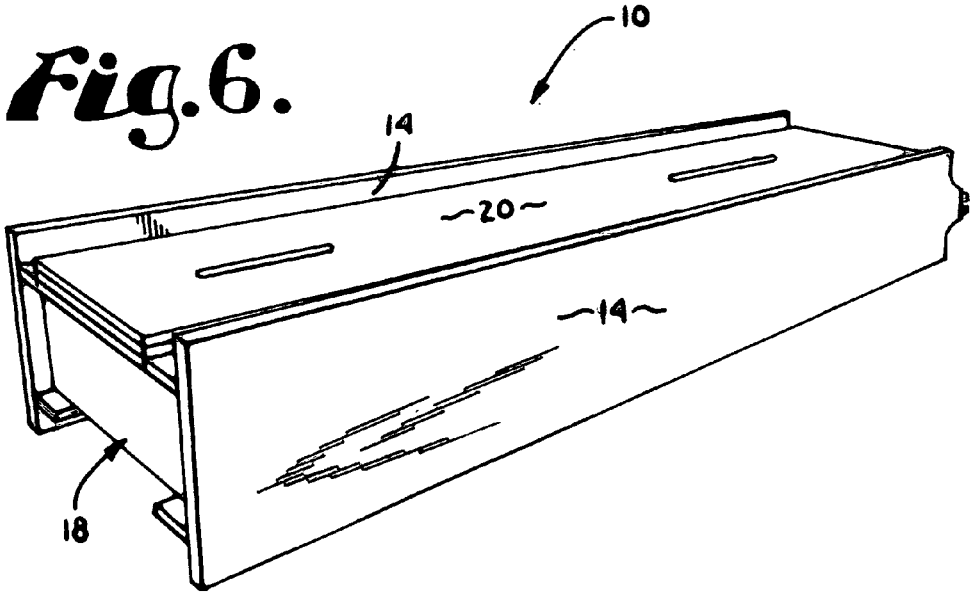

MATTRESS FOUNDATION AND BED FRAME

BACKGROUND OF THE INVENTION

1. Field of the Invention

This invention relates generally to bedroom furniture and, more particularly, to a mattress support which eliminates the need for a conventional box springs.

2. Description of Related Art

Box springs have been used as a component of conventional bedding for decades. At one time the box spring was an important structural component necessary to hold the shape of a mattress which was placed on top of the springs. Modern mattress construction includes integral springs which make a mattress largely self supporting and the underlying box springs largely unnecessary except for the purpose of elevating the mattress to a desired level. It is, of course, known in the art to place a mattress directly onto a flat support, particularly if the mattress is for a twin bed. While this eliminates the need for a separate spring component, the support board is bulky and inconvenient to ship and to handle. It is also known to build a bed support with integral shelving beneath the bed for storage purposes. Such shelving occupies the space between the side rails of the bed and the floor which means that it is not possible to clean under the bed and in some cases, operability of the drawers may be adversely impacted by contact with a carpet.

All of the box springs known in the prior art are made from spring steel which is an increasingly costly material. Particularly in view of the fact that box springs are largely non-functional when used with modern mattresses, this creates a cost component which unnecessarily escalates the expense of a complete bed assembly.

BRIEF SUMMARY OF THE INVENTION

The present invention provides an alternative to a conventional box springs which is less expensive to manufacture, less expensive to ship and offers the option of having integral shelving as a component of a mattress foundation. In its broadest form, the invention encompasses a foundation for supporting a mattress which includes first and second side boards each of which presents a mattress supporting surface; a plurality of tenon and yoke assemblies rigidly coupled with the side boards along their length, and a stretcher board which is adapted to be received by each aligned pair of tenon and yoke assemblies and which accommodates horizontal movement of the aligned assemblies for selecting a desired width for the foundation while being adapted to be rigidly secured to the assemblies to present a unitary mattress support.

One of the objects of the invention is to provide a foundation for supporting a mattress which eliminates the need for a box springs, thus resulting in cost savings over a conventional bed assembly.

It is another one of the objectives of the invention to provide a foundation for supporting a mattress which can be easily assembled and disassembled so that it can be shipped in a compact package at a cost savings over shipping a conventional box springs.

Another one of the objectives of my invention is to provide an alternative foundation for a conventional box springs which can also serve as the bed frame.

An important aim of this invention is to provide a mattress foundation which meets the foregoing objects and which is designed to accommodate mattresses of different widths, thus greatly reducing the inventory of mattress foundations which a distributor or retailer must maintain.

Still another important aim of my invention is to provide a foundation for supporting a mattress which replaces a conventional box springs and also incorporates storage drawers into the foundation in position raised from the floor which drawers occupy the space that would heretofore have been occupied by the box springs.

As a corollary to the foregoing objects and aims, it is an objective of this invention to provide a foundation for supporting a mattress which is suitable for twin, standard, queen and king size mattresses.

Additional aspects of the invention, together with the advantages and novel features appurtenant thereto, will be set forth in part in the description which follows, and in part will become apparent to those skilled in the art upon examination of the following, or may be learned from the practice of the invention. The objects and advantages of the invention may be realized and attained by means of the instrumentalities and combinations particularly pointed out in the appended claims.

BRIEF DESCRIPTION OF THE DRAWINGS

FIG. 3 is an enlarged exploded view of the tenon and yoke assemblies which form a part of the foundation;

FIG. 4 is an enlarged perspective view of the inside of a side board illustrating the tenon and yoke assemblies supporting an optional sliding drawer.

FIG. 5 is an enlarged fragmentary view of a stretcher board which is received by a tenon and yoke assembly, the latter in turn being received by a side board; an optional leg also being illustrated; and FIG. 6 is a perspective view of the foundation of the present invention when it is disassembled for shipment and storage.

Figure 1:
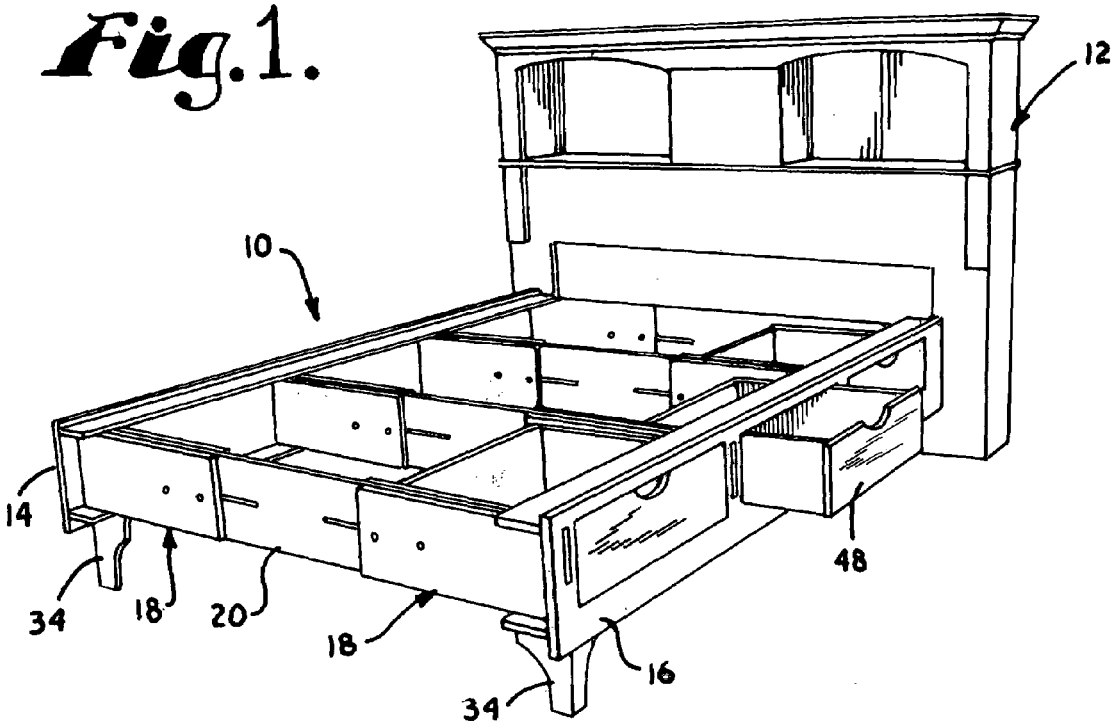
FIG. 1 is a perspective view of the mattress foundation according to the present invention, shown in assembled form and coupled with a headboard.

Referring initially to FIG. 1, the mattress foundation according to the present invention is designated generally by the numeral 10 and is adapted to be coupled with a head board designated generally by the number 12. Foundation 10 comprises first and second side boards 14 and 16, each of which has a plurality of tenon and yoke assemblies 18 rigidly joined to it in spaced apart relationship along its length. The tenon and yoke assemblies on respective side boards are aligned so as to receive a stretcher board 20. The construction of side boards 14 and 16 is illustrated in greater detail in FIG. 4. Side board 16 comprises a vertical component 22 and upper and lower horizontal components 24 and 26. Horizontal components 24 and 26 are either formed integrally with vertical component 22 or are rigidly joined with the vertical component. Top horizontal component 24 of the side board 16 presents a mattress supporting surface **24*a* and it is to be understood that a comparable surface is present on side board 14. Side board 16 also includes a plurality of mortises 28 for receiving the tenon of the tenon and yoke assemblies 18, as will be more fully described hereinafter. Side board 16 also includes a nose extension 30 which mounts hooks 32, which in turn are received on pins (not shown) that are mounted on headboard 12**.

As illustrated in FIG. 5, lower horizontal component 28 of side board 16 presents a surface for mounting a leg 34 to support the side board in a raised position. It is to be understood that legs 34 support one end of side boards 14 and 16, the other ends being supported by headboard 12. In the event no headboard is utilized, two additional legs 34 will support the second ends of side boards 14 and 16.

Referring additionally to FIG. 3, details of the tenon and yoke assembly are illustrated. The yoke is presented by yoke plates 36 which are held in spaced relationship by tenon 38. Dowels 40, which project from each side of tenon 38 and are received in complemental openings 42 in yoke plates 36. The tenon and yoke assembly is shown in its assembled state on the right hand side of FIG. 4 and in FIG. 1.

A stretcher board 20 is positioned between each pair of aligned tenon and yoke assemblies 18 and the stretcher board is shown in greater detail in FIG. 3. Stretcher board 20 comprises a generally rectangular planar member with a horizontally extending slot 20*a* at each end of the board. Nut and bolt assemblies 44 (one of which is shown in FIG. 3) pass through openings in yoke plates 36 and through slots 20*a* to rigidly join the stretcher board to the yoke. It is to be understood that multiple slots in spaced vertical relationship may be employed if desired.

Figure 2:
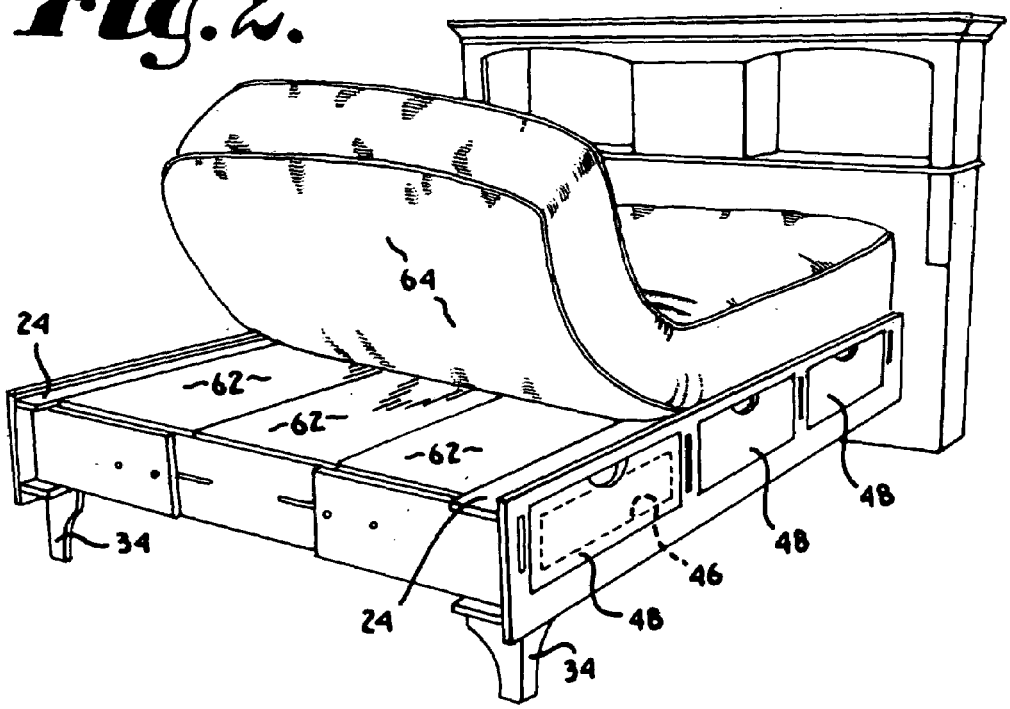
FIG. 2 is a perspective view, similar to FIG. 1, with a mattress placed on a platform surface that is received by the other foundation components.

Referring to further details of side board 16, FIG. 2 shows an opening 46 in phantom lines, which opening receives a drawer 48. It is to be understood that there are three openings 46 along the length of side board 16 and three corresponding drawers 48, although only one drawer will be described in detail. Referring to FIG. 4, drawer 48 includes a front 50, a back 52, sides 54 and a bottom 56. Sides 54 mount slider bars 58 which are received on a pair of tracks 60 that are mounted on the inside surfaces of inner yoke plates 36 of two adjacent yoke and tenon assemblies.

Referring again to FIG. 2, a plurality of elongated planar platform sections 62 are received between upper horizontal components 24 to present a platform surface for supporting a mattress 64.

It is to be understood that the inclusion of openings 46 and drawers 48, along with the associated track and slider mechanisms, is optional and in some instances side board 16 will be identical to side board 14, except for being the mirror image thereof. Such a construction is indicated in FIG. 6 where the foundation is illustrated in its collapsed, unassembled position.

In use, foundation 10 is shipped and stored in the collapsed configuration shown in FIG. 6. To this end, stretcher boards 20 are disassembled from tenon and yoke assemblies 18. Side boards 14 (there being no drawers present) can be placed in closely spaced relationship by offsetting the tenon and yoke assemblies slightly so that the distance between the adjacent side boards will be equal to the length of a single tenon and yoke assembly as indicated in FIG. 6. All of the assembly hardware for securing the yoke and tenon assemblies with the stretcher boards, along with the support legs 34 will easily fit in the open space between the two side boards 14. While not shown in FIG. 6, it is to be understood that platform sections 62 are also of a width to be received in the area between side boards 14. Slider boards 20 are stacked on top of the tenon and yoke assemblies between the two side boards and the entire package is secured.

Not only is savings realized in shipping costs because the volume of foundation 10 is less than a conventional box springs mattress, warehousing costs are also significantly reduced because of the smaller volume of space which is occupied.

It is to be understood, of course, that tenons 38 are permanently secured in mortises 28 so there is no assembly required between tenon and yoke assemblies 18 and side boards 14 and 16. When the foundation is ready for use, the side boards are spaced apart a distance approximately equal to the width of the mattress and the side boards re joined to headboard 12 through hooks 32. The opposite ends of side boards 14 and 16 are supported by legs 34, which are secured to the bottom of lower horizontal components 26 by any suitable manner well known to those skilled in the art. It is to be understood, of course, that headboard 12 is optional, as previously mentioned, and if not used two additional legs 34 are used to support the opposite ends of side boards 14 and 16. It is also to be understood that it may be desirable to provide a foot board (not shown) which, in most cases, will incorporate legs which replace legs 34. A hook assembly comparable to hooks 32 illustrated in FIG. 4 will be provided to secure side boards 14 and 16 to the foot board.

Slots 20*a* in stretcher boards 20 are of a length so that a single stretcher board may be used to accommodate either a twin size or a regular size mattress. Alternatively, the stretcher board may be of a length to accommodate either a regular size or a queen size mattress. The stretcher board is placed between each pair of yoke assemblies and secured by nut and bolt assemblies 44. While one nut and bolt assembly 44 is shown in FIG. 3, it is be understood that typically two such assemblies will be utilized at each end of the stretcher board, both passing through slot 20*a* and received in appropriate openings in the yoke plates 36. Finally, platform sections 62 are placed on the surface presented by stretcher board 20 and adjacent yoke and tenon assemblies 18 to complete the mattress supporting surface in cooperation with upper horizontal components 24 of the side boards.

It is to be understood, of course, that when drawers 48 are incorporated into the foundation 10, it is not possible to ship or store the foundation in the configuration shown in FIG. 6, but rather the two side boards will be stacked of one on top of the other. Even in this configuration, however, there are still savings in volume over a conventional box springs. It is to be understood that rather than using dowels 40 the yoke plates 36 and tenons 38 may be rigidly joined by a suitable adhesive.

Another advantage of the invention is with king size beds where heretofore two box springs have been required to support the oversize mattress. Utilizing the present invention, a foundation may be provided as herein described with the only modification being providing a center leg beneath each stretcher board to provide additional support. It is also within the scope of the invention to provide a stretcher board which is of a size to accommodate both a queen size and king size mattress with the aforementioned center legs being needed only with the king size configuration.

While wood is the preferred material for constructing the mattress foundation of the present invention, it is to be understood that man made materials could be utilized and are within the scope of the present invention.

From the foregoing it will be seen that this invention is one well adapted to attain all ends and objectives hereinabove set forth, together with the other advantages which are obvious and which are inherent to the invention.

Since many possible embodiments may be made of the invention without departing from the scope thereof, it is to be understood that all matters herein set forth or shown in the accompanying drawings are to be interpreted as illustrative, and not in a limiting sense.

While specific embodiments have been shown and discussed, various modifications may of course be made, and the invention is not limited to the specific forms or arrangement of parts and steps described herein, except insofar as such limitations are included in the following claims. Further, it will be understood that certain features and subcombinations are of utility and may be employed without reference to other features and subcombinations. This is contemplated by and is within the scope of the claims.

What is claimed and desired to be secured by Letters Patent is as follows:

1. A foundation for supporting a mattress, said foundation comprising:

first and second side boards each having a width selected to support a mattress at a height above a surface, each of said side boards presenting a mattress supporting surface;

a plurality of tenon and yoke assemblies rigidly coupled with said side boards in spaced apart relationship along the length of said side boards, said assemblies on said first side board being aligned with said assemblies on said second side board;

a stretcher board adapted to be received by each aligned pair of tenon and yoke assemblies, said stretcher board accommodating horizontal movement of said aligned assemblies and being adapted to be rigidly secured to said assemblies to present a unitary foundation for supporting said mattress.

2. The invention of claim 1, wherein said stretcher board is of a length sufficient to provide a foundation to support mattresses of varying sizes.

3. The invention of claim 1, wherein each of said side boards is adapted to be coupled with a head board.

4. The invention of claim 1, wherein each one of an adjacent pair of said assemblies on one of said side boards includes a track, and wherein said one side board includes an opening between said tracks and further including a drawer received in said side board opening and supported on said track.

5. The invention of claim 1, wherein a leg is provided at each end of each side board for supporting said side boards and said assemblies in an elevated position.

6. The invention of claim 1, wherein is included a plurality of said stretcher boards and corresponding tenon and yoke assemblies along the length of said side boards and further including a platform surface supported by said stretcher boards and extending between said side boards.

7. A foundation for supporting a mattress, said foundation comprising:

first and second side boards each having a width selected to support a mattress at a height above a surface, each of said side boards presenting a mattress supporting surface and being adapted to be coupled with a head board at one end;

a plurality of tenon and yoke assemblies rigidly coupled with said side boards in spaced apart relationship along the length of said side boards, said assemblies on said first side board being aligned with said assemblies on said second side board;

a plurality of stretcher boards adapted to be received by said tenon and yoke assemblies, each of said stretcher boards being of a length sufficient to provide a foundation for a mattress and having a slot at each end to accommodate horizontal movement of said tenon and yoke assemblies coupled therewith for varying the effective length of said stretcher board to accommodate mattresses of varying widths; and a releasable keeper for rigidly coupling each tenon and yoke assembly to said stretcher board, said keeper being received in said slot.

8. The invention of claim 7, wherein each of said side boards is adapted to be coupled with a foot board.

9. A foundation for supporting a mattress, said foundation comprising:

first and second side boards each having a width selected to support a mattress at a height above a surface, each of said side boards presenting a mattress supporting surface and being adapted to be coupled with a head board at one end, one of said side boards having an opening for accommodating a drawer;

a plurality of tenon and yoke assemblies rigidly coupled with said side boards in spaced apart relationship along the length of said side boards, said assemblies on said first side board being aligned with said assemblies on said second side board, at least one pair of adjacent assemblies having a track;

a plurality of stretcher boards adapted to be received by said tenon and yoke assemblies, each of said stretcher boards being of a length sufficient to provide a foundation for a mattress and having a slot at each end to accommodate horizontal movement of said tenon and yoke assemblies coupled therewith for varying the effective length of said stretcher board to accommodate mattresses of varying widths;

a releasable keeper for rigidly coupling each tenon and yoke assembly to said stretcher board, said keeper being received in said slot; and a drawer received in said opening in said side board and movable over said track.

10. The invention of claim 9, wherein said one side board has a plurality of openings and said assemblies adjacent each of said openings includes a track and wherein is included a plurality of said drawers.

11. A foundation for supporting a mattress, said foundation comprising:

first and second side boards each having a width selected to support a mattress at a height above a surface, each of said side boards presenting a mattress supporting surface and being adapted to be coupled with a head board at one end;

a plurality of tenon and yoke assemblies rigidly coupled with said side boards in spaced apart relationship along the length of said side boards, said assemblies on said first side board being aligned with said assemblies on said second side board;

a plurality of stretcher boards adapted to be received by said tenon and yoke assemblies, each of said stretcher boards being of a length sufficient to provide a foundation for a mattress and having a slot at each end to accommodate horizontal movement of said tenon and yoke assemblies coupled therewith for varying the effective length of said stretcher board to accommodate mattresses of varying widths; and means received in said slot for rigidly coupling each tenon and yoke assembly to said stretcher board.

12. The invention of claim 11, wherein each one of an adjacent pair of said assemblies on one of said side boards includes track means for accommodating movement of a drawer relative to said side board and wherein said one side board includes an opening between said track means and further including a drawer received in said side board opening and moveable relative to said track means.

* * * * *